United States Patent [19]

Vesterby

[11] Patent Number: 4,645,377

[45] Date of Patent: Feb. 24, 1987

[54] METHOD OF CAUSING SEDIMENTATION OF SEDIMENTARY SOLID MATERIAL TRANSPORTED IN A BODY OF WATER, SUCH AS A LAKE, A SEA, OR AN OCEAN

[75] Inventor: Hans Vesterby, Frederikshavn, Denmark

[73] Assignee: Danmarks Geotekniske Institut, Lyngby, Denmark

[21] Appl. No.: 611,950

[22] PCT Filed: Oct. 6, 1983

[86] PCT No.: PCT/DK83/00092

§ 371 Date: May 15, 1984

§ 102(e) Date: May 15, 1984

[87] PCT Pub. No.: WO84/01590

PCT Pub. Date: Apr. 26, 1984

[30] Foreign Application Priority Data

Oct. 8, 1982 [DK] Denmark ..... 4474/82

[51] Int. Cl.[4] ..... E02B 3/06; E02B 8/02; E02B 11/00

[52] U.S. Cl. ..... 405/74; 405/15; 405/21; 405/43; 405/50

[58] Field of Search ..... 405/15, 16, 21, 24, 405/25, 29–32, 36, 43–46, 48–52, 74

[56] References Cited

U.S. PATENT DOCUMENTS

| | | | |
|---|---|---|---|
| 606,980 | 7/1898 | Poincy | 405/74 |
| 2,135,337 | 11/1938 | Herbest | 405/32 |
| 2,745,768 | 5/1956 | Karch | 405/52 |
| 3,565,491 | 2/1971 | Frazier . | |
| 3,733,831 | 5/1973 | Sticker | 405/30 |
| 4,030,306 | 6/1977 | Larsen | 405/21 |
| 4,180,348 | 12/1979 | Taylor | 405/43 X |
| 4,182,581 | 1/1980 | Uehara et al. | 405/43 |

FOREIGN PATENT DOCUMENTS

| | | | |
|---|---|---|---|
| 835873 | 7/1951 | Fed. Rep. of Germany . | |
| 7205562 | 4/1972 | Netherlands . | |
| 2018552 | 3/1979 | United Kingdom . | |
| 728741 | 5/1980 | U.S.S.R. | 405/15 |
| 853000 | 8/1981 | U.S.S.R. | 405/52 |

OTHER PUBLICATIONS

"New Method for Beach Erosion Control", Jerry L. Machemehl, Thomas French and Norden E. Huang, 1975, vol. 1, pp. 142–160.

*Primary Examiner*—Richard J. Scanlan, Jr.
*Assistant Examiner*—Nancy J. Stodola
*Attorney, Agent, or Firm*—Birch, Stewart, Kolasch & Birch

[57] ABSTRACT

In a sea, lake or other body of water, sedimentation of sedimentary solid material may be obtained in desired areas by reducing the hydraulic pressure in the sea floor or lake bottom layer in the respective area. Such reduction of the hydraulic pressure causes water to flow from the lake or sea into the porous bottom or floor layer whereby material suspended in the water or transported along the bed settles on the floor or bottom. The reduction of the hydraulic pressure is obtained by pumping water from underground drain tubes or other drainage devices extending along and adjacent to the coastline. The method may be used for coast protection and reclamation of land.

17 Claims, 5 Drawing Figures

Figure 1:
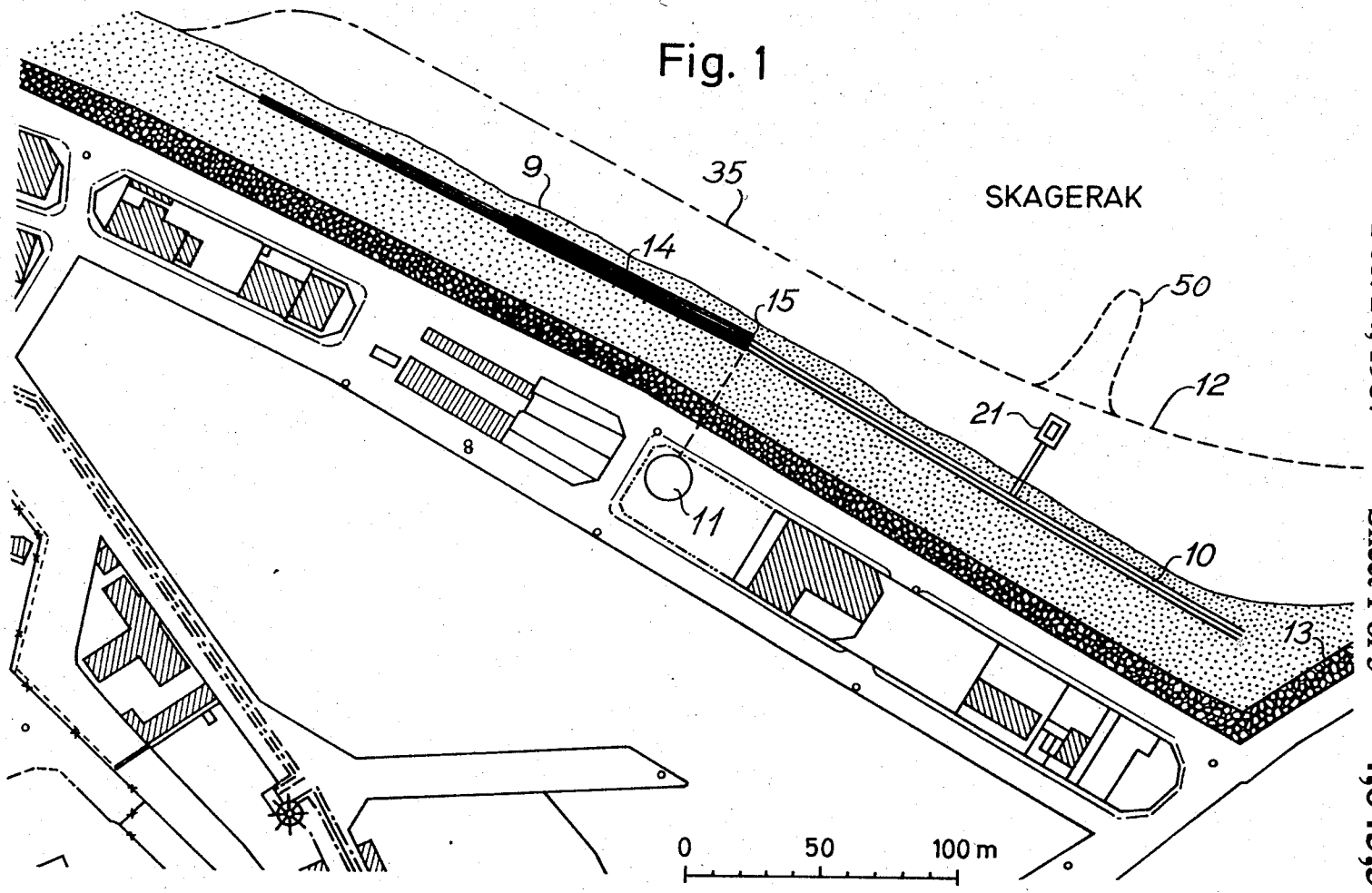

METHOD OF CAUSING SEDIMENTATION OF SEDIMENTARY SOLID MATERIAL TRANSPORTED IN A BODY OF WATER, SUCH AS A LAKE, A SEA, OR AN OCEAN

BACKGROUND OF THE INVENTION

The present invention relates to a method of causing sedimentation of suspended or otherwise transported sedimentary solid material at the upper surface of a porous substratum of a natural body of water, such as a lake, a sea or an ocean.

Some coastal stretches and banks along oceans, seas, lakes and rivers, as well as areas of the substratum, floor or bottom below such bodies of water are exposed to influences from waves or currents, whereby the coastlines or banks and the substratum or floor are continuously changed. As an example, sea currents may erode the coast in certain areas and transport material therefrom to other areas of the sea, where the material settles. Along certain stretches of a coast the erosion may be so vigorous that the coastline may move substantially inwards in a few years so that buildings, such as hotels, summer houses, and other installations, which were originally located at a substantial distance from the coast, are endangered. Therefore, several efforts have been made to develop efficient methods of coast protection. From old times it has been known to protect a coast by means of groynes which extend transversely to the coastline and are positioned with relatively small spacing. Such groynes are relatively efficient, but they are expensive to build and to maintain. Groynes are often used in combination with solid structures or dikes extending substantially parallel to the coast—so-called sea walls—which also resist coastal erosion. In later years experiments have been made with artificial seaweed, which is made from plastic and has been anchored to the sea floor in areas exposed to erosion. It was believed that the artificial seaweed would promote sedimentation of sedimentary material. Coast protection by means of artificial seaweed has, however, proved less efficient than expected.

An often used method of coast protection is the so-called artificial nourishment. By this method sand may be transferred from deeper areas of the sea to the beach or to the sea floor adjacent to and in front of the stretch of the coast exposed to erosion, for example by means of a suction dredger, or sand may be transported to and unloaded on the foreshore of the exposed coast by means of trucks or other vehicles. As the sand supplied in this manner is eventually removed due to the littoral drift, the artificial nourishment must be repeated at certain time intervals in order to be effective. As the known method of artificial nourishment involves handling and transport of large amounts of sand and must be repeated rather frequently, this method of coast protection is relatively expensive.

German patent specification No. 835.873 discloses a method of land reclamation in coastal areas near salt water seas. This known method involves the supply of fresh water to the salt-water saturated foreshore. As fresh water is normally not available in large quantities in coastal areas, this known method is not suited for use in a larger scale.

Proc. Civ. Engrg. in the Oceans/III, Newark, Del., 1975, Vol. I, pp. 142–160 describes an experimental study which was carried out in a water wave channel which was 50 feet long, 2 feet wide, and 3 feet deep. A perforated pipe extending along the length of the water wave channel (i.e. at right angles to the pretended 2 feet long coastline) constituted a sub-sand filter system from which water was pumped. The effectiveness of the system on stabilizing the offshore profile, on stabilizing the foreshore profile, and on decreasing the breaker scour was determined. It was found that the sub-sand filter system had a stabilizing effect on the bed material in the offshore zone, a negligible effect on breaker scour in the breaker zone, and was efficient in speeding accretion in the foreshore zone.

SUMMARY OF THE INVENTION

The present invention provides a method of causing sedimentation of suspended or otherwise transported sedimentary solid material at the upper surface of a porous substratum of a natural body of water, such as a lake, a sea, or an ocean, and along a borderline (such as a coastline or the edge of a lake) between the body of water and an adjacent land area. The method according to the invention is characterized in removing water by means of a drain which extends along and adjacent to the borderline, and which is positioned below the mean upper surface level of the body of water, in an amount so as to reduce the hydraulic pressure in the porous substratum immediately below the upper surface thereof in a zone along said borderline.

It has surprisingly been found that removal of water from such a drain which extends along the borderline may essentially reduce the hydraulic pressure in the porous floor or bottom of the sea or lake over a rather broad zone of the sea floor or lake bottom along the drain. This means that sedimentation or accretion of sedimentary material may be obtained in a rather broad zone on the water side of the borderline or coastline without using transversely extending drains. Such sedimentation or accretion of sedimentary material may, for example, be used for protection of sea coasts or lake edges exposed to erosion, and for land reclamation.

A reduction of the hydraulic pressure in the porous substratum, which may be the floor of a sea or ocean or the bottom of a lake or a river, gives rise to sedimentation because water is caused to flow from the body of water into the porous substratum, whereby sedimentary material suspended in the water or transported along the top surface of the porous substratum or bed, is retained at the bed. Water may be removed from the drain continuously or discontinuously. As an example, the removal of water may take place during periods of storm degradation and be stopped during periods of natural accretion.

DETAILED DISCUSSION

The drain used in carrying out the method according to the invention may be of any suitable type. Thus, for example, water may be pumped from a natural water-bearing stratum or aquifer or any other natural drain, such as a gravel layer extending along the borderline and covered by sand. The water may alternatively or additionally be removed through at least one artificial drain embedded in the substratum along the borderline or coastline.

The drain from which the water is pumped or removed may extend along the borderline on the water side thereof. However, in order to make it easier to establish the drain it is preferably positioned on the land side of the borderline or in the land area and below the ground water level at that location. Removal or pumping of water from such a drain causes a lowering of the ground water level. It has been found that such a lowering of the ground water level adjacent to the coastline or on the beach may cause sedimentation of large amounts of sedimentary material along the coast so that additional land may be formed immediately outside the original coastline in a few days or weeks. The explanation of this phenomenon is that part of the water rushing up upon the beach due to swell or wave motion will seep down through the sand layers on the beach because of the lowered ground water level. Therefore, an essential part of the sedimentary material transported by the wave uprush will settle on the beach and will be carried back into the sea or lake by the wave backrush as usual. Consequently, the beach will eventually expand outwards.

The ground water level may be lowered by pumping water from a natural drain of the type mentioned above, and/or from at least one artificial drainage device positioned underground at a locaton adjacent to the coastline and below the ground water level at that location. The drainage device or devices may be of any type, which makes it possible to remove or pump ground water therefrom in such an amount that the ground water level is lowered to the extent desired. The drainage device or devices may, for example, be one or more fascines, wells, borings, or well-points, which are arranged in mutually spaced relationship along the borderline or coastline. Such spaced wells, borings, well-points, or fascines may be interconnected by means of tubes which may be perforated, if desired, so that they are in the form of drain tubes.

When only a single or a few closely spaced fascines, wells, borings or well-points are used the sedimentation caused thereby may form a tongue of land extending transversely to the original coastline. Such a tongue of land may serve as a kind of groyne, which may protect the coast because the littoral drift is changed so as to cause sedimentation at the upstream side of the tongue.

Normally, it is desired to protect a relatively long stretch of coast. In such a case the drain preferably comprises at least one drain tube or pipe, which is surrounded by an outer layer of a filter material for preventing blocking of the perforations of the tube. The number of drain tubes, which may be arranged substantially parallel to the coast to be protected, may be chosen in dependency of the amount of water to be removed in order to maintain the ground water at the desired low level.

The drain should be arranged relatively close to the coastline in order that the desired effect may be obtained. If the drain is arranged on the land side of the daily high water line, the drain may, without any difficulty, be placed underground below the ground water level independently of the tide. However, the sedimentation effect is decreased when the spacing of the drain from the high water line is increased. Therefore, in order to obtain a good sedimentation effect the drain should not be positioned too far from the high water line. As an example, the drain could be placed 1–10 m and preferably about 5 m from the daily high water line at the land side thereof.

The more the ground water level is lowered along the coastline, the wider is the sea or lake area in which a sedimentation effect is obtained. However, the amount of ground water to be pumped away from the drainage device or devices is also increased when the ground water level is lowered. A suitable compromise seems to be obtained when the drain is positioned 0.5–3 m, and preferably 1–2 m below the mean upper surface level of the body of water or the mean sea level.

Generally, the position of the drain in relation to the coastline or borderline, the level of the drain, and/or the volume rate of water removed or pumped from the drain and returned to the sea or body of water are chosen in relation to the water permeability of the substratum or floor or bottom layers, and to the desired width of the sedimentation or accretion zone along the coastline or borderline.

According to the invention, the ground water level may be lowered by removing water from an upwardly open hollow or dip, such as a ditch or an artificial or natural basin, positioned on the land side of the daily high water line, the bottom of the hollow being positioned below the mean upper surface level of the body of water or below the ground water level. Such a hollow may replace or be used in combination with other kinds of drains or drainage devices. Water may be pumped from the hollow in order to lower the ground water level. However, when the body of water is subjected to tides or surges, water may be removed from the hollow through at least one passage extending from an inlet positioned in the hollow and below the mean upper surface level of the body of water, to an outlet which is also positioned below this mean upper surface level and so as to pass water from the hollow to the body of water under the influence of gravitational forces when the upper surface level of the body of water is lower than that of the water within the hollow. In such a case and with tides the ground water level may be lowered during certain periods of the day under the influence of gravitational forces. If desired, water may be pumped from the hollow or dip during the remaining period.

When the method according to the invention is used for protecting a stretch of coast by establishing additional land outside the original coastline, such coast protection in reality also means reclamation of a narrower or wider strip of land. However, the method according to the invention makes it possible to reclaim more land than possible with conventional coast protection measures. Thus, when a first additional land has been formed outside the original coastline by lowering the ground water level in accordance with the invention, it is possible to establish a drain or drains in the first additional land so as to lower the ground water level therein so that a new second additional land is established outside the first additional land. This procedure may be repeated till a desired area of new land has been obtained. The new land may be protected by conventional means, for example by means of groynes, sea walls, or similar structures. However, it is also possible to protect the new coast by permanently keeping the ground water at a predetermined lowered level which is sufficient to maintain the coastal profile at equilibrium.

The reduction of the hydraulic pressure in the porous substratum by pumping water directly from a drain may be permanently maintained. However, it is also possible to stop the removal of water from the drain when a suitable foreshore or layer of sedimentary material has been built up, and removal of water from the drain may be resumed when the foreshore or layer of sedimentary material has been more or less removed by the normal action of waves and currents, or possibly in connection with a gale.

Figure 2:
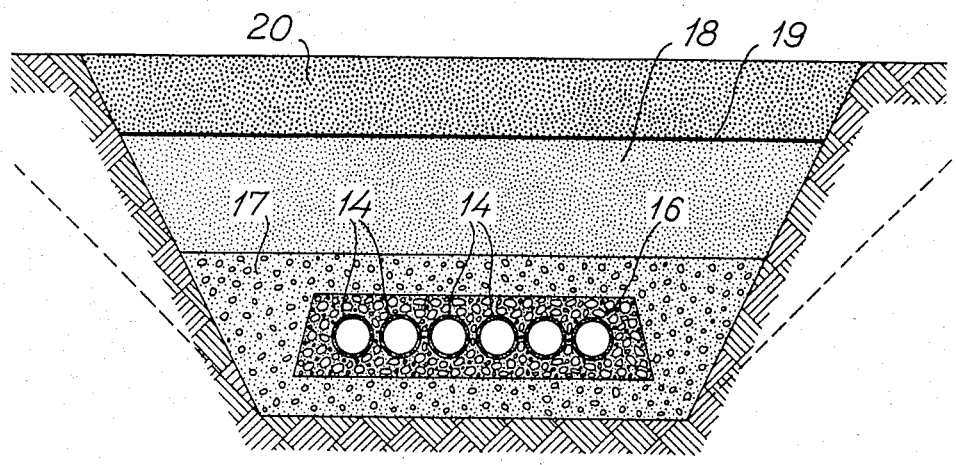
Figure 3:
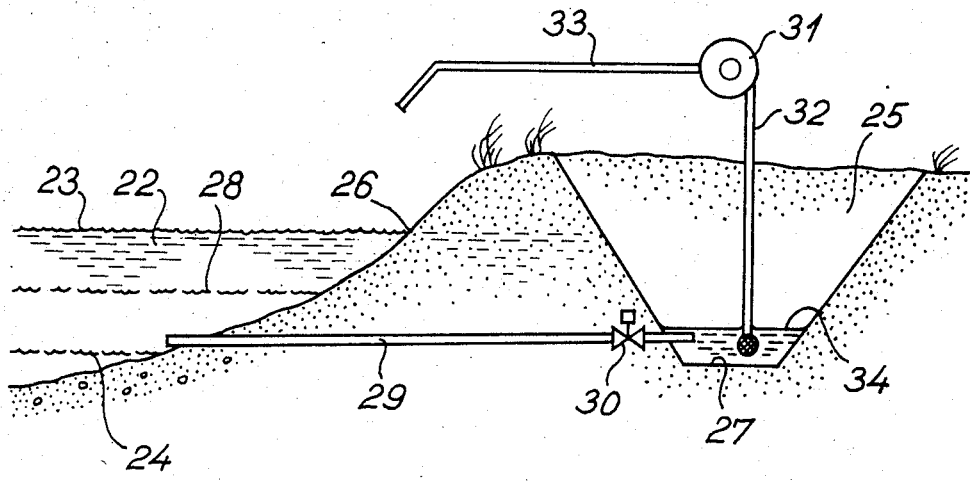
Figure 4:
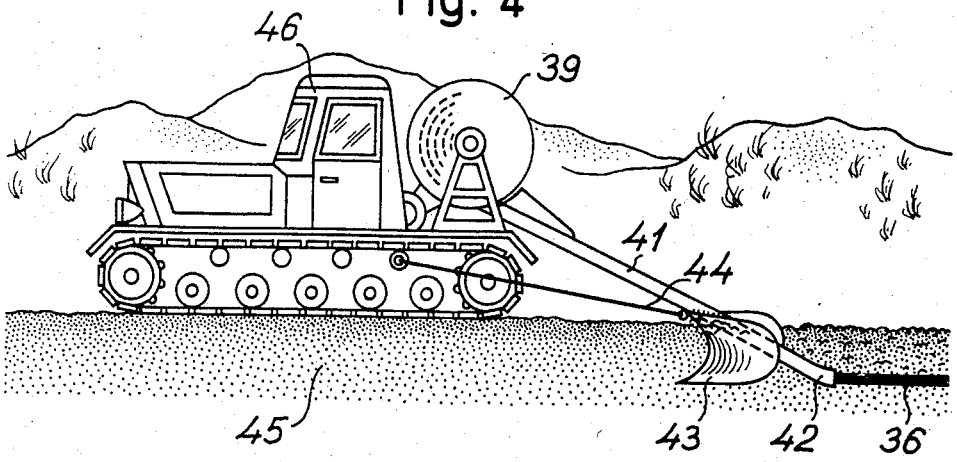
Figure 5:
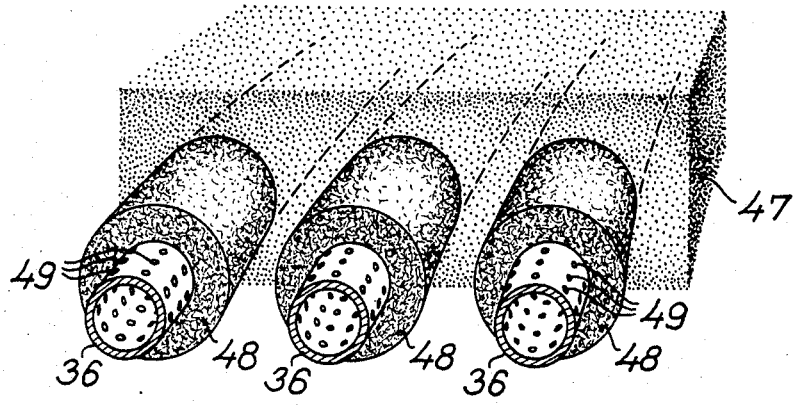

The invention will now be further described with reference to the drawings, wherein:

FIG. 1 is a diagrammatic plan view showing underground drain tubes arranged along a coastline, FIG. 2 is a cross-sectional view showing the drain tubes of FIG. 1 in an enlarged scale, FIG. 3 is a cross-sectional view of a coast where a ditch extending along the coastline has been established, FIG. 4 illustrates how a flexible drain tube may be placed in the ground in a beach area, and FIG. 5 is a perspective and sectional view of flexible drain tubes with a sheathing of filter material arranged in a body of sand or other material.

In order to supply salt water to tanks for salt-water fish and to large heat pumps, drain tubes were arranged underground on the land side of, but closely adjacent to the coastline 9 of the Skagerak in the vicinity of the harbour of the Danish town Hirtshals as illustrated in FIG. 1. The drain tubes 10 were connected to a pumping station 11 which proved able to supply the necessary amount of salt water from the drain tubes to the salt water tanks. However, after a relatively short time the amount of salt water which could be delivered from the drain tubes was substantially reduced, and when the water supply system had been in operation for about one week, the amount of salt water which could be delivered by the drain tubes 10 was completely insufficient for the intended purpose. The reason was a deposition of sand which is indicated by a dotted line 12 in FIG. 1, and which had been formed in a corner defined between the coastline 9 along which the drain tubes 10 were placed and an adjacent, transversely extending breakwater 13 of the harbour.

In order to reestablish the necessary capacity of the salt water supply, additional drain tubes 14 were laid down along a 220 m long stretch of the coast in continuation of the drain tubes 10. The new drain tubes 14 were connected to the drain tubes 10 first established at a connecting point 15 where the inlet to the pumping station 11 was also positioned. The 220 m long stretch where the new drain tubes 14 were positioned was divided into a first length of 100 m adjacent to the connecting point 15, a second length of 50 m, a third length of 50 m, and a fourth length of 20 m as indicated in FIG. 1. The drain tubes 14 comprised six parallel and mutually spaced drain tubes extending along the first length, four drain tubes extending along the second length, three drain tubes extending along the third length, and a single drain tube extending along the fourth length. The drain tubes 14 were laid down into a ditch which was dug on the land side of the coastline or daily high water line 9 and approximately 5 m therefrom, and in order to facilitate the digging of the ditch, wellpoints for removal of ground water were arranged on both sides of the ditch with a mutual spacing of 1 m.

FIG. 2 shows a sectional view of the ditch close to the connecting point 15 where six drain tubes 14 were arranged at the bottom of the ditch side by side. Each drain tube 14 was a corrugated, perforated flexible tube made from polyvinyl chloride with an inner diameter of 185 mm and an outer diameter of 200 mm. As shown in FIG. 2 the drain tubes 14 were laid down into a bed comprising an inner layer 16 of gravel having a drain size of 4–10 mm, and an outer layer 17 of sand with a grain size of 0.5–2 mm. The outer sand layer 17 was covered by a further layer 18 of pure sand, and the upper surface of the layer 18 was positioned at zero level, i.e. mean sea level, and covered by a plastic film 19 with a thickness of 0.15 mm. The remaining upper part of the ditch was filled to ground level with earth 20, mainly consisting of sand. The drain tubes 14 were positioned so as to extend upwardly from the level −2 m (this means 2 m below the mean water level) with an inclination of 3–5 per thousand to the level −1.25 m (1.25 m below the mean water level). The ground level was about +0.5 m above the mean water level.

After the drain tubes 14 had been laid down and connected to the pumping station 11 they were able to deliver initially an amount of salt water corresponding to about 2 $m^3$ per hour for each meter of the 220 m long drain. This means that the drain tubes 14 were able to deliver about 440 $m^3$ per hour. When the drainage system had been in continuous use for one week the maximum amount of water was only 0.5 $m^3$ per hour for each meter of the drain, and an accretion of about 30 m of land between the coastline 9 and a new coastline 35 was obtained along the drain lines 14 as indicated with a dot-and-dash line in FIG. 1.

Furthermore, a fascine 21 was established in the deposition of sand 12, and this fascine was connected to the drain tubes 10. When the fascine had been in operation for a period of time, a tongue 50 of sand extending transversely to the coastline had been formed as indicated by a dotted line in FIG. 1.

The drainage system described above with reference to FIGS. 1 and 2 was not established with the purpose of coast protection or land reclamation, but, nevertheless, a considerable sedimentation of sand was obtained along the coast where the drain tubes 10 and 14 were arranged. The sedimentation was obtained because the pumping of large volumes of salt water from the drain tubes 10 and 14 caused a considerable lowering of the ground water level in the area where the drain tubes are arranged, and the consequent reduction of the hydraulic pressure in the foreshore layers is transmitted to the adjacent sea floor layer, whereby sea water will flow into the floor layer to compensate for the reduction in hydraulic pressure, and the sedimentary material suspended in the sea water will then settle on the sea floor.

FIG. 3 is a diagrammatic sectional view of a shore and a coast at a sea 22, subject to tides between a high tide level 23 and a low tide level 24. A ditch 25 is established on the land side of and close to the coastline 26. The bottom surface 27 of the ditch 25 is positioned below the mean tide level 28 and preferably close to the low tide level 24, and each of a plurality of water outlet tubes or canals 29 is provided with a valve or gate 30 and extends from the bottom part of the ditch 25 to a position around the low tide level 24. The ditch may alternatively or additionally be provided with a pump 31 with an inlet tube 32 extending down to the bottom of the ditch 25, and an outlet tube 33 having its discharge into the sea 22.

If water is not removed from the ditch 25 the upper level of the water therein will correspond to the ground water level in the adjacent coastal area. The valves 30 of the outlet tubes 29 may be opened when the sea water level due to the tide is below the ground water level. The water 34 will then start flowing out into the sea through the outlet tubes 29, whereby the ground water level in the adjacent area is lowered. The valves 30 are preferably closed when the sea water level starts to rise from the low tide level 24, and at any rate before the sea water level reaches the level at which the outlet tubes 29 are communicating with the ditch 25 in order to avoid the sea water flowing back into the ditch 25 through the tubes 29. The lowering of the ground water level obtained exclusively by gravitational forces may cause sedimentation of sedimentary material on the sea floor as explained above. This effect may be further amplified if water is pumped from the ditch 25 by means of the pump 31 when the valves 30 are closed. The function of the valves 30 may, for example, be remotely controlled in dependency of the actual sea water level and the level of the water 34 in the ditch 25. The valves 30 may, alternatively, be simple one-way valves allowing water to flow only from the ditch 25 into the sea, but not in the opposite direction.

FIG. 4 diagrammatically illustrates a method of embedding a drain tube or pipe 36 in the ground 45 along a coast. As shown in FIG. 4, the drain tube 36 is coiled up on a reel 39 which is rotatably mounted at the rear end of a tractor 46. The drain tube 36 is passed from the reel 39 through a guide tube 41 and is moved out from the guide tube 41 through a backwardly curved lower end portion 42 thereof. This end portion 42 is mounted on a plough member 43, which forms a furrow for receiving the drain tube 36 in the sand or ground 45. The furrow will collapse around the drain tube 36 laid down therein. The plough member 43 is suspended by means of the guide tube 41 and a pair of wires 44 (only one is shown in the drawing) so as to be vertically movable to a desired depth. In the manner described above a number of parallel, mutually spaced drain tubes 36 may be embedded in a beach or along the edge of a lake where it is desired to cause sedimentation of sedimentary material, for example in order to stabilize the coast or to reclaim land.

FIG. 5 shows a body of sand 47 which may, for example, be part of the foreshore along a coastline. The parallelly extending, mutually spaced, perforated drain tubes 36, which are embedded in the sand body 47 are each surrounded by a sheathing 48 which should prevent the perforations 49 of the drain tubes 36 from becoming blocked by grains of sand or other particles. The sheathing may, for example, be made from a fibrous material, and may then be positioned around the drain tube 36 when it is coiled up on the reel 39 and laid down as illustrated in FIGS. 4 and 5. The sheathing 48 of fibrous material may be replaced by a filter layer of sand or gravel with a grain size exceeding the diameter of the perforations 49 and preventing sand and other particles with a smaller grain size from passing therethrough. A filter layer of this type may, for example, be poured into the furrow which is made by the plough member 43.

It should be understood that various changes and modifications of the method described above may be made within the scope of the present invention. As an example, the sedimentation effect may be increased, if water is pumped from drains embedded in a sea floor area adjacent to a coast, where the ground water level is simultaneously lowered on the land side.

What is claimed is:

1. A method of settling sedimentary solid material which is suspended in and transported by a natural body of water having a porous substratum, said method comprising:

establishing an underground drain juxtapositioned to and extending in substantially the same general direction of a borderline, between said body of water and a main land area, said drain being positioned below a mean upper surface level of said body of water; and reducing hydraulic pressure in said porous substratum of said body of water immediately below said mean upper surface water level thereof along a zone adjacent and corresponding to said drain by removing water from said drain, whereby sedimentary material is caused to settle in said zone of said substratum.

2. A method according to claim 1, wherein said drain is established in said land area below ground water level at that location.

3. A method according to claim 1, wherein said drain comprises at least one perforated drain tube, which is surrounded by an outer layer of a filter material for preventing blocking of the perforations of the tube.

4. A method according to claim 3, wherein said filter material is a layer of sand or gravel with a thickness of at least 15 cm.

5. A method according to claim 3, wherein said filter material is a fibrous plastic material.

6. A method according to claim 2, wherein said drain comprises an upwardly open cavity formed in the ground, having a bottom which is positioned below said mean upper surface level of the body of water, said mean upper surface level of the body of water being the same as the ground water level.

7. A method according to claim 6, said body of water being subjected to tides, said method comprising removing water from the cavity through at least one passage extending from an inlet positioned in the cavity and below the mean upper surface level of the body of water to an outlet which is also positioned below this mean upper surface level and so as to pass water from the cavity to the body of water under the influence of gravitational forces when the upper surface level of the body of water is lower than that of the water within the cavity.

8. A method according to claim 7, wherein said passage is opened when the upper surface level of the body of water is lower than a predetermined position below the level of water within the cavity, and closed when the upper surface level of the body of water is higher than said predetermined level.

9. A method according to claim 1, wherein said water is removed at a rate so as to reduce the hydraulic pressure in the porous substratum in a zone having a width of from 5–100 m transversely to the borderline.

10. A method according to claim 9, wherein the width of the zone is about 30 m.

11. A method according to claim 1, wherein water is removed from the drain at a rate of 0.1–5 $m^3$ per hour for each meter of the length of the drain.

12. A method according to claim 1, wherein the drain is positioned about 0.5–3 m below the mean upper surface level of the body of water.

13. A method according to claim 2, wherein the drain comprises at least one perforated drain tube, which is surrounded by an outer layer of a filter material for preventing blocking of the perforations of the tube.

14. A method according to claim 9, wherein water is removed at a rate so as to reduce the hydraulic pressure in the porous substratum in a zone having a width of from 10–50 m transversely to the borderline.

15. A method according to claim 11, wherein water is removed from the drain at a rate of 0.5–2 $m^3$ per hour for each meter of the length of the drain.

16. A method according to claim 12, wherein the drain is positioned about 1–2 m below the mean upper surface level of the body of water.

17. A method according to claim 1, wherein the zone in which the hydraulic pressure is reduced is a littoral zone where littoral drift frequently occurs.

* * * * *

REEXAMINATION CERTIFICATE (1390th)

United States Patent [19] [11] B1 4,645,377

Vesterby [45] Certificate Issued Dec. 4, 1990

[54] METHOD OF CAUSING SEDIMENTATION OF SEDIMENTARY SOLID MATERIAL TRANSPORTED IN A BODY OF WATER, SUCH AS A LAKE, A SEA, OR AN OCEAN

[75] Inventor: Hans Vesterby, Frederikshavn, Denmark

[73] Assignee: Beach Management Systems, Danmark A/S, Lyngby, Denmark

Reexamination Request:
No. 90/001,826, Aug. 16, 1989

Reexamination Certificate for:

| | |
|---|---|
| Patent No.: | **4,645,377** |
| Issued: | **Feb. 24, 1987** |
| Appl. No.: | **611,950** |
| Filed: | **May 15, 1984** |

[22] PCT Filed: Oct. 6, 1983

[86] PCT No.: PCT/DK83/00092

§ 371 Date: May 15, 1984

§ 102(e) Date: May 15, 1984

[87] PCT Pub. No.: WO84/01590

PCT Pub. Date: Apr. 26, 1984

[30] Foreign Application Priority Data

Oct. 8, 1982 [DK] Denmark ..... 4474/82

[51] Int. Cl.[5] ..... E02B 3/06; E02B 8/02

[52] U.S. Cl. ..... 405/74; 405/15; 405/21; 405/43; 405/50

[58] Field of Search ..... 405/73, 74

[56] References Cited

FOREIGN PATENT DOCUMENTS 6410874 9/1964 Netherlands .
7205562 4/1972 Netherlands .

OTHER PUBLICATIONS

Grant, U. S., "Influence of the Water Table on Beach Aggradation and Degradation", J. Mar. Res. 7(3), 655–660 (1948).

"Beach Erosion Pipeline Urged", Philadelphia Inquirer, Jun. 4, 1972, 2–7.

Chappell, J. et al., "Experimental Control of Beach Face Dynamics by Watertable Pumping," Q. J. Eng. Geol. 14 (1979), pp. 29–41.

Advertising Brochure of Moretrench American Corporation.

Powers, J. P., Construction Dewatering, J. Wiley & Sons (1981).

*Primary Examiner*—Dennis L. Taylor

[57] ABSTRACT

In a sea, lake or other body of water, sedimentation of sedimentary solid material may be obtained in desired areas by reducing the hydraulic pressure in the sea floor or lake bottom layer in the respective area. Such reduction of the hydraulic pressure causes water to flow from the lake or sea into the porous bottom or floor layer whereby material suspended in the water or transported along the bed settles on the floor or bottom. The reduction of the hydraulic pressure is obtained by pumping water from underground drain tubes or other drainage devices extending along and adjacent to the coastline. The method may be used for coast protection and reclamation of land.

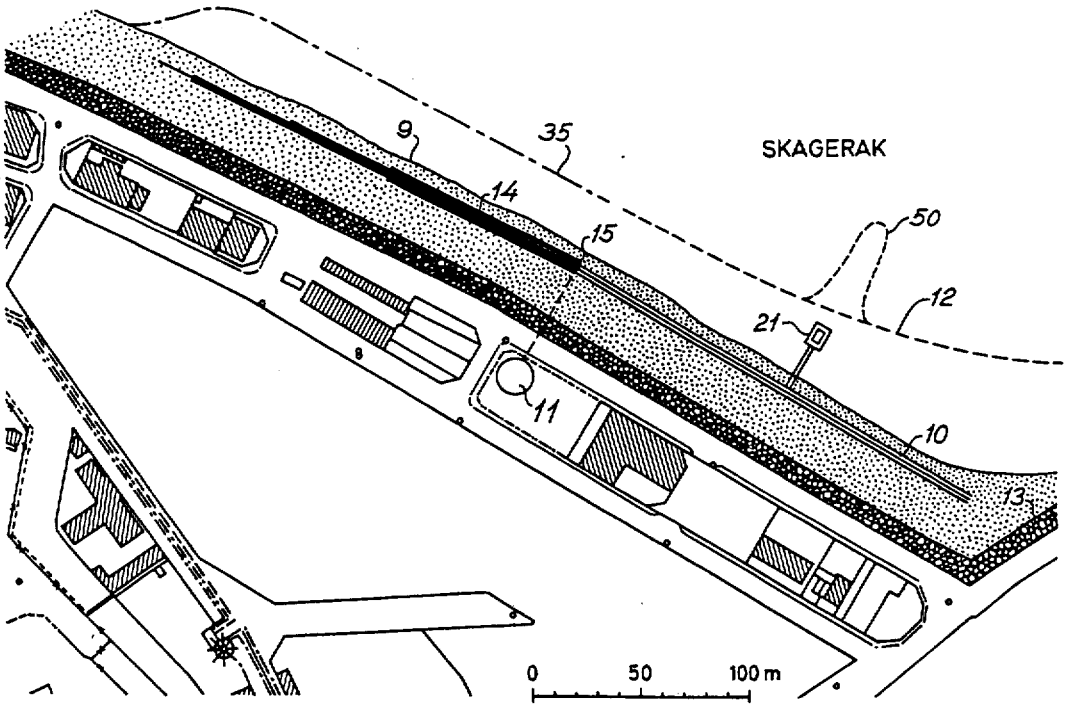

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, line 64 to column 3, line 16 as follows:

The drain from which the water is pumped or removed may extend along the borderline on the water side thereof. However, in order to make it easier to establish the drain it is preferably positioned on the land side of the borderline or in the land area and below the ground water level at that location. Removal or pumping of water from such a drain causes a lowering of the ground water level. It has been found that such a lowering of the ground water level adjacent to the coastline or on the beach may cause sedimentation of large amounts of sedimentary material along the coast so that additional land may be formed immediately outside the original coastline in a few days or weeks. The explanation of this phenomenon is that part of the water rushing up upon the beach due to swell or wave motion will seep down through the *porous* sand layers on the beach because of the lowered ground water level. Therefore, an essential part of the sedimentary material transported by the wave uprush will settle on the beach and will *not* be carried back into the sea or lake by the wave backrush as usual. Consequently, the beach will eventually expand outwards.

Column 5, line 14 to column 5, line 33 as follows:

In order to supply salt water to tanks for salt-water fish and to large heat pumps, *substantially horizontal, buried* drain tubes were arranged underground on the land side of, but closely adjacent to the coatline 9 of the Skagerak in the vicinity of the harbour of the Danish town Hirtshals as illustrated in FIG. 1. The drain tubes 10 were connected to a pumping station 11 which proved able to supply the necessary amount of salt water [from] *collected and transported by* the drain tubes to the salt water tanks. However, after a relatively short time the amount of salt water which could be delivered from the drain tubes was substantially reduced, and when the water supply system had been in operation for about one week, the amount of salt water which could be delivered by the drain tubes 10 was completely insufficient for the intended purpose. The reason was a deposition of sand which is indicated by a dotted line 12 in FIG. 1, and which had been formed in a corner defined between the coastline 9 along which the drain tubes 10 were placed and an adjacent, transversely extending breakwater 13 of the harbour.

AS A RESULT OF REEXAMINATION, IT HAS BEEN DETERMINED THAT:

Claims 6, 7 and 8 are cancelled.

Claim 1 is determined to be patentable as amended.

Claims 2–5 and 9–17, dependent on an amended claim, are determined to be patentable.

New claims 18–21 are added and determined to be patentable.

1. A method of settling sedimentary solid material which is suspended in and transported by a natural body of water having a porous substratum *and an adjacent porous land area*, said method comprising:

[establishing an underground] *positioning a substantially horizontally disposed buried* drain [juxtapositioned] *adjacent* to and extending in substantially the same general direction of a borderline[,] between said body of water and [a main] *said* land area, said *buried* drain being positioned *to collect water* below a mean upper surface level of said body of water; and reducing hydraulic pressure in *a zone comprising* said porous substratum of said body of water [immediately below said mean upper surface water level thereof along a] *near said borderline, and the adjacent land area by removing water from the vicinity of said buried drain by collecting and removing this water from said buried drain by gravity or pumping to cause settling of said sedimentary solid material at a surface of said* zone [adjacent and corresponding to said drain by removing water from said drain, whereby sedimentary material is caused to settle in said zone of said substratum].

*18. A method of settling sedimentary solid material which is suspended in and transported by a natural body of water having a porous substratum and an adjacent porous land area, said method comprising:*

*(a) positioning at least one underground, substantially horizontal drain tube in said land area adjacent to and extending in substantially the same direction as a borderline between said body of water and said land area, said drain tube being positioned below said mean upper surface level of said body of water; and*

*(b) removing water from the vicinity of said drain tube by collecting and removing this water from said drain tube by gravity or pumping to reduce the hydraulic pressure in a zone comprising the land area adjacent to said drain tube, and the corresponding substratum of said body of water near said borderline to cause settling of said sedimentary solid material at a surface of said zone.*

*19. A method of settling sedimentary solid material which is suspended in and transported by a natural body of water having a porous substratum, said method comprising:*

*establishing an undergound drain juxtapositioned to and extending in the same general direction of a borderline, between said body of water and a main land area, said drain being positioned below a mean upper surface level of said body of water; and*

*reducing hydraulic pressure in said porous substratum of said body of water immediately below said mean upper surface level thereof along a zone adjacent and corresponding to said drain by removing water from said drain, whereby sedimentary material is caused to settle in said zone of said substratum, wherein said drain is established in said land area below ground water level at that location and comprises an upwardly*

*open cavity formed in the ground, having a bottom which is positioned below said mean upper surface level of the body of water, said mean upper surface level of the body of water being the same as the ground water level.*

*20. A method according to claim 19, said body of water being subjected to tides,*

*said method comprising removing water from the cavity through at least one passage extending from an inlet positioned in the cavity and below the mean upper surface level of the body of water to an outlet which is also positioned below this mean upper surface level and so as to pass water from the cavity to the body of water under the influence of gravitational forces when the upper surface level of the body of water is lower than that of the water within the cavity.*

*21. A method according to claim 20, wherein said passage is opened when the upper surface level of the body of water is lower than a predetermined position below the level of water within the cavity, and closed when the upper surface level of the body of water is higher than said predetermined level.*

* * * * *